US008610035B2

(12) United States Patent
Yoshidome

(10) Patent No.: US 8,610,035 B2
(45) Date of Patent: Dec. 17, 2013

(54) DRAWER TYPE COOKING DEVICE

(75) Inventor: Akihiro Yoshidome, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 807 days.

(21) Appl. No.: 12/700,318

(22) Filed: Feb. 4, 2010

(65) Prior Publication Data

US 2010/0200563 A1 Aug. 12, 2010

(30) Foreign Application Priority Data

Feb. 6, 2009 (JP) ..... 2009-026637

(51) Int. Cl.
*H05B 3/68* (2006.01)

(52) U.S. Cl.
USPC ..... 219/452.11; 219/454.11

(58) Field of Classification Search
USPC ..... 219/452.11, 454.11
See application file for complete search history.

(56) References Cited

U.S. PATENT DOCUMENTS

| | | | | |
|---|---|---|---|---|
| 4,663,508 | A * | 5/1987 | Ishimura et al. | 219/723 |
| 4,814,571 | A * | 3/1989 | Bowen et al. | 219/757 |
| 6,849,835 | B2 * | 2/2005 | Bollmers et al. | 219/520 |
| 2003/0116031 | A1 * | 6/2003 | Choi et al. | 99/357 |
| 2004/0035861 | A1 * | 2/2004 | Lee | 219/715 |
| 2005/0173399 | A1 | 8/2005 | Yoshidome et al. | |
| 2006/0043087 | A1 * | 3/2006 | Gagas et al. | 219/391 |
| 2006/0191923 | A1 | 8/2006 | Yoshidome | |
| 2006/0278629 | A1 * | 12/2006 | Gagas et al. | 219/385 |
| 2007/0278218 | A1 * | 12/2007 | Claesson et al. | 219/681 |
| 2008/0078243 | A1 * | 4/2008 | Jeon et al. | 73/290 R |
| 2008/0156202 | A1 * | 7/2008 | Park et al. | 99/467 |
| 2010/0327759 | A1 * | 12/2010 | Zwerver et al. | 315/210 |

FOREIGN PATENT DOCUMENTS

| | | | |
|---|---|---|---|
| JP | 2006-184091 | A | 6/2005 |
| JP | 2005-221081 | A | 8/2005 |
| JP | 2006-038316 | A | 2/2006 |
| JP | 2006-223336 | A | 8/2006 |
| JP | 2007-139386 | A | 6/2007 |

OTHER PUBLICATIONS

Japense Office Action issued Aug. 28, 2012.

* cited by examiner

*Primary Examiner* — James Mitchell
(74) *Attorney, Agent, or Firm* — Birch, Stewart, Kolasch & Birch, LLP

(57) ABSTRACT

The invention provides a drawer type cooking device having a cooling fan 56*a* disposed laterally, so that a space 70 is formed below the cooling fan 56*a*, enabling a high pressure transformer 55 to be disposed efficiently using this space 70. By the combination of the arrangement, position and orientation of the cooling fan, it becomes possible to reduce the set depth size at the farthest portion of the cooking device body 1. By reducing the depth size, the front surface of a cabinet and the front surface of a door 2 can be disposed flush with each other, without having to sacrifice the depth of the heating chamber 6.

12 Claims, 9 Drawing Sheets

DRAWER TYPE COOKING DEVICE

The present application is based on and claims priority of Japanese patent application No. 2009-026637 filed on Feb. 6, 2009, the entire contents of which are hereby incorporated by reference.

BACKGROUND OF THE INVENTION

1. Field of the Invention

The present invention relates to a cooking device in general, and more specifically, to a drawer type cooking device in which a drawer body storing an object to be heated is capable of being drawn out from within a cooking device body.

2. Description of the Related Art

Cooking devices having a drawer body formed integrally with a door capable of being drawn out to the front side of the cooking device have been proposed. Since such drawer type cooking devices can be built into the space below the countertop of kitchens, the cooking devices can be installed without occupying the space above the countertop used for preparation of cooking or for the actual cooking, they are suitably adopted in kitchen arrangements where multiple cooking devices are arranged three-dimensionally. The drawer type cooking devices are positioned as one of the cooking equipment constituting fitted kitchens or designed kitchens, and the use thereof is spreading widely, especially in the United States.

The present applicant has proposed a drawer type cooking device as one example of a drawer type microwave oven comprising a cooking device body having a heating chamber, a drawer body capable of being moved within the cooking device body so as to be drawn out to the exterior from within the heating chamber of the cooking device body, and a slide rail for moving the drawer body within the cooking device body, wherein the slide rail is disposed outside the heating chamber, so that the slide mechanism does not have to be formed of members or materials having high heat resistance and flame resistance, and the occurrence of discharge failure due to microwave can be prevented (patent document 1: Japanese patent application laid-open publication No. 2005-221081).

One example of a prior art built-in cooking device is shown in FIGS. 4 through 6. FIG. 4 is a perspective view showing one example of the built-in cooking device to which the prior art drawer type cooking device is applied, FIG. 5 is a side view of the built-in cooking device shown in FIG. 4, and FIG. 6 is a perspective view showing the built-in cooking device of FIG. 4 with the drawer body drawn out.

As shown in FIGS. 4 and 5, the built-in cooking device comprises a cooking device body 1 having overall rectangular shape, a door 2*a* capable of having a drawer body 2 drawn out from the cooking device body 1 via a slide mechanism 9 including a movable rail 10 and being disposed on the front side of the cooking device body 1 so as to close the heating chamber 6, an operation panel disposed on the front side of the cooking device body 1 above the door 2*a*, and a power supply cord 4 extending from a connection portion 7 disposed on a farthest portion of the cooking device body 1.

The drawer body 2 has a door 2*a* disposed on the front side thereof, and further comprises a table for mounting an object to be cooked and a wall portion 12 surrounding the same. The cooking device is a built-in device, and as shown in FIGS. 2A and 2B, it is assembled to a kitchen cabinet 5 having a cooking top 5*a* formed on the upper side thereof. The control panel 3 according to the present example is disposed integrally with the cooking device body 1, so that the door 2*a* can be drawn out independently from the control panel 3. FIG. 6 shows the state in which the door 2*a* is drawn out.

Cooking devices such as microwave ovens that use electric power must have a power supply cord 4 extending from the cooking device plugged into an outlet to obtain power from commercial power supplies and the like. According to a cooking device built-in from the front side, the device is being built-in with the power supply cord 4 disposed on the rear side 1*a* of the cooking device body 1 connected to a connecting portion 7, so that the cord must have at least a length corresponding to the depth of the cooking device body 1 from the rear side 1*a* of the cooking device body 1 to the connecting portion 7. Since the periphery of the built-in cooking device is surrounded by other cooking equipment or a casing, the power supply cord 4 must be stored in the external space outside the cooking device body formed between the rear side 1*a* of the cooking device body 1 and a back wall 5*c* of the kitchen cabinet 5 at the rear side of the heating chamber 6, in which space the cord is bent in a manner folded from the extended state. According to this type of storing method of the power supply cord 4, the power cord may easily be sandwiched in the gap between the farthest portion of the cooking device body 1 and the kitchen cabinet 5, which may lead to damage of the cord. Therefore, the present applicant has proposed a method of forming a storage space for storing the power supply cord between the ceiling panel of the cooking device body and the ceiling of the cabinet (patent document 2: Japanese patent application laid-open publication No. 2006-223336).

As described in the document, since not enough outer space can be ensured between the rear side of the set and the back of the kitchen cabinet according to the prior art, the power supply cord 4 is stored on the ceiling panel of the set during build-in operation of the cooking device, instead of bending and folding the cord from the extended state and hanging it in the external space of the cooking device body. According to the arrangement, a space for storing the excess portion of the power supply cable that occurs after storing the device so as to prevent the cable from being sandwiched between the farthest portion of the casing and the cabinet is required, and therefore, the casing structure can be overlapped.

FIGS. 7A and 7B illustrate the arrangement of electric components at the farthest portion of a prior-art built-in cooking device. FIG. 7A is a right side view, and FIG. 7B is a rear view thereof. Various electric components for activating the electrically-operated cooking device are arranged at the farthest portion 8. The electric components include, as described above, a magnetron 54 as a high frequency generation device, a high pressure transformer 55, a high pressure capacitor, and a fan motor 56 for driving a cooling fan 56*a*.

Traditional cooking devices on countertop are almost without exception supplied with air inlet and outlet over back panel and side panels of the outer cabinet, taking in air through air inlet for the purpose of cooling electrical components and others, and discharging through air outlet hot air with vapor emitting from foods cooked to be scattered into the thin kitchen air. Such configuration in design to place such air inlet and outlet over insignificant areas of the cabinet to counterpart inner configurations requires only ordinary engineering skills and practices. On the other hand, built-in cooking devices are allowed to take in and discharge air only by way of limited square inches that could be spared apparently on the front surface, posing design challenges toward specialists in the trade to decide upon cooking device configurations.

Therefore, built-in cooking devices as shown in FIGS. 7A and 7B intend to cope with configuration of taking in and discharging air that is applicable to built-in installations as follows:

A lower end portion 59 disposed below the heating chamber 3 of the cooking device body 1 constitutes a bottom surface air inlet and outlet duct structure communicated with the front side air inlet 63. A fan motor 56 for driving a cooling fan 56*a* which is a electric component is disposed at the farthest portion 8 of the cooking device body 51. The fan motor 56 is positioned vertically (with the rotation axis positioned horizontally). When the fan motor 56 is activated, outside air is sucked in through the air inlet 63 via the bottom surface air inlet and outlet duct structure and flown in the direction of the arrow, where the cooling air is temporarily sent out to the outer space through the opening formed on the back wall of the cooking device body, and then sucked in again through an appropriate opening formed on the back wall of the cooking device body 51 into the cooking device body 51 to reach the farthest portion 8, to thereby cool the heat-generating electric components such as the high pressure transformer 55, the high pressure capacitor and the circuit board. The cooling air inside the farthest portion 8 is further blown into the interior of the cooking device body 1 via the fan motor 56. In other words, a portion of the air being sent out via the fan motor 56 cools the magnetron 54 which is an electric component functioning as a high frequency generation device, flows into the heating chamber 6, and then flows through the heating chamber air outlet duct and is discharged to the exterior.

As described, according to the prior art built-in cooking device, it was impossible to store all the paths through which cooling air flow passes within the cooking device body, in order for the depth of the cooking device body to be stored within the determined limited space. As a result, the air blow path was detoured to pass the space outside the cooking device body as a trade-off for realizing the desired cooking body depth, though the path seems irrational as an air blow path based on the knowledge of those in the field of art. According to the above-mentioned air blow path, the cross-sectional area of the air blow path was varied greatly, so that it was difficult to increase the air blow volume, and since the arrangement caused great pressure loss, there was great air blow loss and the air blow efficiency of the cooling fan 56*a* was deteriorated. Therefore, it is a challenge to further reduce the depth of the cooking device, correct the irrational air blow path and thereby improve the air blow efficiency of the cooling fan 56*a*.

Further, regarding the trend of interior designs, kitchens composed of built-in equipment having no protruded portions are highly evaluated, but according to the prior art drawer type cooking device, it was impossible to form the front door of the device to be flush with the front panel of the cabinet since the rear portion of the casing constituting the cooking device body was supported at the back of the cabinet, so that the door portion was protruded from the front panel of the cabinet. Therefore, there were cases where even if the functions of the cooking device were highly evaluated, the device was not adopted in fitted kitchens or designed kitchens since the design thereof did not match the interior design of the kitchens. As described, the drawer type microwave oven as an example of a drawer type cooking device belongs to a field of cooking devices where there is no price competition and where high added value is demanded, so that the drawer type microwave must answer to design expectations from users putting weight on realizing a kitchen with a unified interior design, and must provide superior specifications so as not to disappoint the users having high expectations on the performance and structure of the device.

As for physical structural conditions, the heating chamber of the cooking device must have a structure enabling food and drinks favored by the users to be heated in a smooth manner, and the height of the ceiling of the heating chamber must enable ready-made containers and mug cups offered by various fast food shops and coffee shops to be easily stored therein. Furthermore, regarding the size of the bottom surface of the heating chamber, in Japan, the chamber must be able to store packed lunches sold in supermarkets, convenience stores and other shops, while in the United States, the chamber must be able to at least store a pizza box offered by popular pizza shops. As described, the most important design challenge in this field of art is to have full knowledge of the size of the heating chamber desired by the user, and to ensure the minimum allowable heating chamber size.

The present inventors having overcome the prior art challenge of enabling a drawer type cooking device to be built into kitchen cabinets have gained the position as a manufacturer providing the one and only microwave oven that can be built into kitchen cabinets, but now face a new challenge of realizing higher performance and improved structure.

The problem to be solved according to the present invention is to devise the position and orientation of electric components disposed in a concentrated manner at the farthest portion on the rear side of the cooking device so as to reduce the depth size of the farthest portion while maintaining the opening size of the chamber when the door is drawn out, and to enable the cooking device to be completely stored within the cabinet.

The object of the present invention is to provide a drawer type cooking device having reduced the depth size of the farthest portion of the cooking device, so as to enable the cooking device to be completely embedded in the cabinet without reducing the opening size of the heating chamber when the door is completely drawn out, to thereby enable the front panel of the door to be flush with the front panel of the cabinet, enhance the flatness of the built-in device and improve the interior design property of the device.

SUMMARY OF THE INVENTION

The present invention aims at solving the problems of the prior art by providing a drawer type cooking device comprising a cooking device body having a heating chamber, a drawer body disposed movably within the cooking device body via a movement mechanism so as to be drawn out from within the heating chamber, electric components working to heat an object to be cooked within the heating chamber and a cooling fan disposed on a farthest portion of the cooking device body, wherein the electric components include a high pressure transformer and a high frequency generation device, and a set depth size of the farthest portion is reduced by combining the arrangements, positions and orientations of the high pressure transformer and the cooling fan.

According to the drawer type cooking device, the set depth size of the farthest portion can be reduced by combining the arrangements, positions and orientations of the high pressure transformer and the cooling fan which are included in the various electric components disposed at the farthest portion of the cooking device for activating the device. By reducing the depth size of the farthest portion of the device, the front surface of the door can be made flush with the front panel of the cabinet without sacrificing the opening size of the door being drawn out, and there is no longer any need for a special ceiling structure for storing the electric cord for power supply on the ceiling.

According to the present drawer type cooking device, it is preferable to dispose the cooling fan laterally, and to position the high pressure transformer in the opened space below the cooling fan. By positioning the cooling fan laterally, a space is formed below the fan, and the high pressure transformer can be stored efficiently using the formed space.

According to the drawer type cooking device of the present invention, the device can be built into the walls of kitchen cabinets having a standardized size, and the front side of the door can be made flush with the front panel of the cabinet, so that a superior interior design having completely-flat built-in equipment can be realized.

The power supply cable can be suspended in the course of the construction process, according to which the workability is improved. There is no need to form a power cable storage portion to the cooking device body, so that the weight and cost of the cooking device body can be reduced.

DETAILED DESCRIPTION OF THE PREFERRED EMBODIMENTS

Figure 1B:
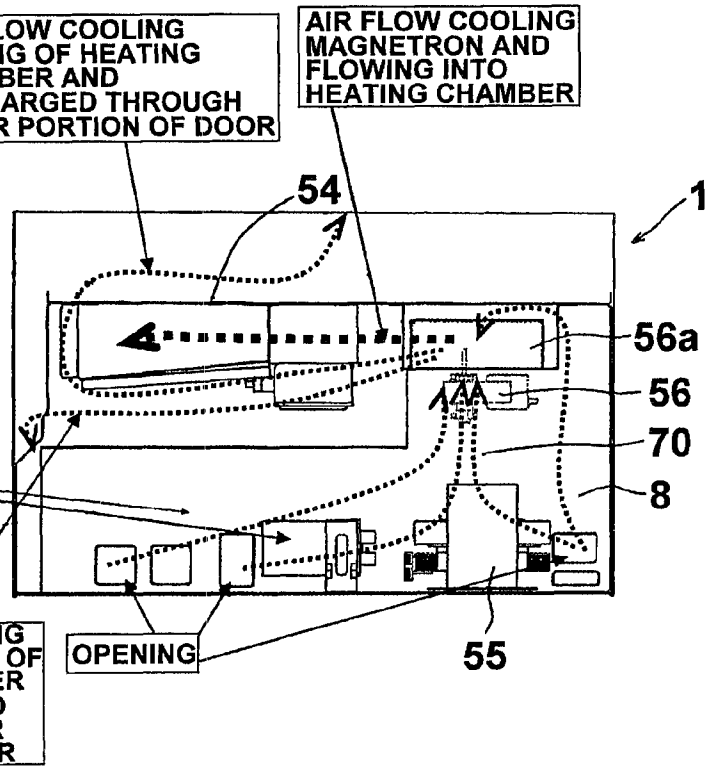
FIG. 1B is a rear side view showing a rear side chamber of the embodiment in which a drawer type cooking device according to the present invention is applied to a built-in kitchen equipment.
Figure 1A:
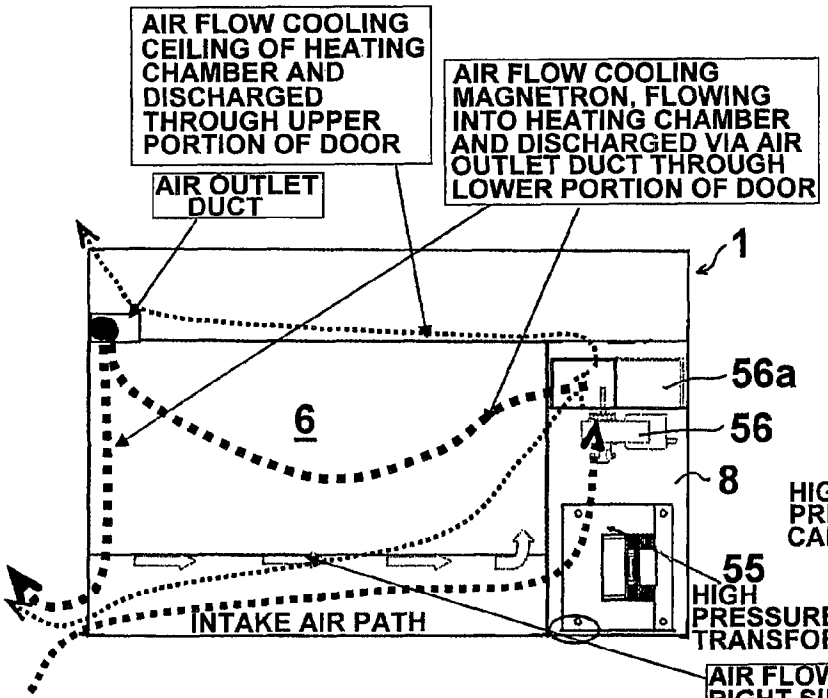
FIG. 1A is a right side view showing a rear side chamber of an embodiment in which a drawer type cooking device according to the present invention is applied to a built-in kitchen equipment.

Now, the preferred embodiments of the drawer type cooking device according to the present invention will be described with reference to the drawings. One example of the drawer type cooking device according to the present invention applied to a built-in cooking equipment is illustrated in FIGS. 1A and 1B. The basic structure of the drawer type cooking device are equivalent to those of the prior art drawer type cooking device, so the components are denoted by the same reference numbers and the detailed descriptions thereof are omitted. FIG. 1A is a right side view and FIG. 1B is a rear side view showing a rear side chamber according to one embodiment where the drawer type cooking device is applied to a built-in kitchen equipment. In the rear view, the back wall 5*c* is removed.

A rear wall (back panel) 1*a* of the heating chamber is extended in four directions and acts as a partition wall with respect to the back area. A farthest portion 8 of the cooking device is formed at the rear side of a back surface (rear wall) 1*a* of the heating chamber, and basic electric components for activating the cooking device are stored in the farthest portion 8. The farthest portion of the cooking device includes, as basic electric components, a magnetron 54 which is a high frequency generation device for generating microwave, a high pressure transformer 55 for generating high pressure voltage for applying a high pressure voltage to the magnetron 54, and a high pressure capacitor. The farthest portion also includes a cooling fan 5*a* for sending cooling air for cooling the magnetron 54, the high pressure transformer 55 and the like.

As an improvement related to the arrangement of the components in the farthest portion, the direction of the cooling fan 56*a* is changed. Further, the cooling fan 56*a* has a casing with a perpendicular air inlet and a horizontal air outlet. Since the cooling fan 56*a* is arranged laterally (with the rotary axis disposed vertically), the height occupied by the cooling fan 56*a* is reduced, contributing to reducing the overall height of the cooking device.

The cooling fan 56*a* sends cooling air towards the high pressure transformer 55, cools the high pressure transformer 55 and circuit boards such as a high pressure capacitor, and finally discharges the air used for cooling to the exterior of the cooking device. On the other hand, a high frequency generation device having a fin-like radiation member is disposed close to the air outlet of the casing, wherein the air flow sent out through the air outlet by the cooling fan 56*a* cools the radiation member of the high frequency generation device, passes through a duct-like air flow path and flows into the heating chamber 6 through an opening formed on the wall of the heating chamber. The air containing the heat and moisture within the heating chamber is sent out to the exterior of the heating chamber 6, and is finally discharged to the exterior of the cooking device. As described, two cooling air flows are generated using a single cooling fan 56*a* to cool the heat radiating electric components arranged in a concentrated manner in the farthest portion of the device.

Figure 10:
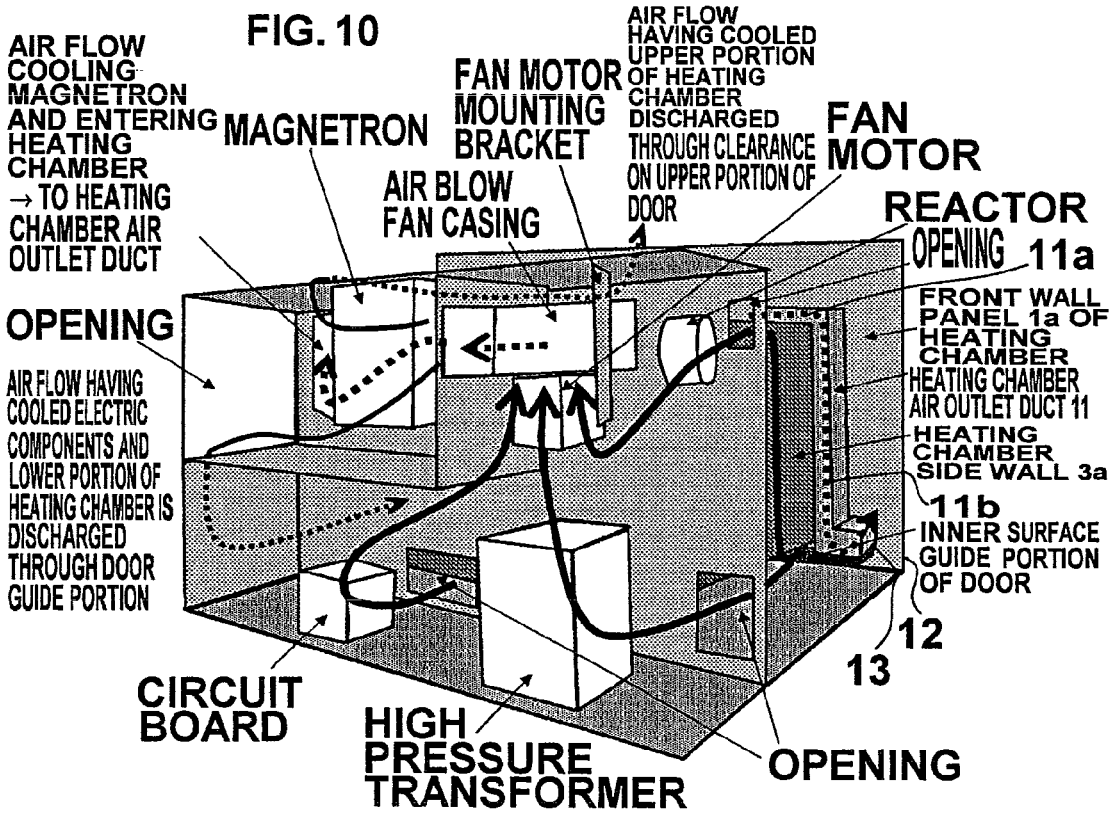
FIG. 10 is a perspective view taken from a rear right side of the cooking device illustrating one example of an air blow path of the drawer type cooking device shown in FIGS. 1A and 1B.

FIG. 10 is a conceptual view showing one example of air blow cooling for driving the cooling fan 56*a* and sending the air sucked in from the exterior to the heating chamber 3. The air flow generated by the cooling fan 56*a* flows through the cooking device from the lower portion of the front side of the cooking device, and passes through multiple openings formed to the back panel 1*a* of the heating chamber 3 having different sizes corresponding to electric components having high heat radiation, forming multiple air flows flowing toward the farthest portion. The multiple air flows flowing into the farthest portion respectively cool electric components such as the high pressure transformer 55 and the circuit board, and are sucked into the casing and converged, before being sucked into the cooling fan 56*a*. A major portion of the air having been sent out from the cooling fan 56*a* via the air outlet of the casing cools the magnetron 54, flows through the duct-like air flow path into the heating chamber 3, and thereafter, passes through a heating chamber air outlet duct 11 to be guided to the lower portion of the cooking device, before being discharged to the exterior.

The air flow flowing into the heating chamber 6 flows out through an air outlet opening formed on the ceiling panel of the heating chamber as discharge air, guided through an air outlet duct arranged mainly in the perpendicular direction from the outlet opening toward the bottom portion of the heating chamber 6, and then discharged to the exterior from the lower portion of the front side of the cooking device.

Since the operating characteristics of magnetron 54 is especially varied greatly by temperature, the cooling air quantity thereof must be ensured in priority to other heat generation components. The cooking device illustrated in FIG. 10 performs air blow cooling with the magnetron 54 and the cooling fan 56*a* disposed close to one another so that the cooling air flow quantity of the magnetron 54 will not be influenced by the arrangement of other electric components.

The shape, the installation position and the installation orientation of the high pressure transformer 55 are varied, as one of the improvements in the arrangement of the farthest portion components. Since the cooling fan 56*a* is disposed laterally, a space 70 is formed below the cooling fan 56*a*, and the high pressure transformer 55 having a rectangular shape can be erected in the space 70. The change of orientation of the high pressure transformer 55 reduces the depth dimension occupied by the high pressure transformer 55, and as a result, the depth of the farthest portion 8 can be reduced.

As described, by reducing the depth of the farthest portion 8 and simultaneously arranging the air flow path for cooling the electric components disposed at the farthest portion 8 to be completed within the cooking device body 1 without using the outer space on the exterior of the cooking device body 1, it becomes possible to improve the cooling effect by enhancing the cooling air volume and wind speed and to improve the air blow efficiency of the cooling fan, to thereby achieve the effect of cutting down costs due to the minimized output of the fan motor.

The prior art drawer type cooking device had an air flow duct isolated from the heating chamber disposed on the lower portion of the product, that is, the lower portion of the cooking device body 1. It is known that during the drop test for dropping a packaged product from a height equal to or higher than the height of the back of a truck, the impact of the drop causes the air flow duct to deform elastically, and the high pressure transformer 55 as weight component is vibrated severely in both vertical and horizontal directions. Therefore, it is especially necessary to increase the installation intensity of the high pressure transformer 55, and there were limitations in the installation position, the installation method and the installation orientation of the high pressure transformer 55. According to the present embodiment, the air flow duct disposed on the lower portion of the product is eliminated and the air flow is performed within the product, so that the prior art limitations regarding the installation of the high pressure transformer 55 specific to the drawer type cooking device are resolved, and the installation orientation of the high pressure transformer as described in the present embodiment is enabled.

Figures 8A, 8B:
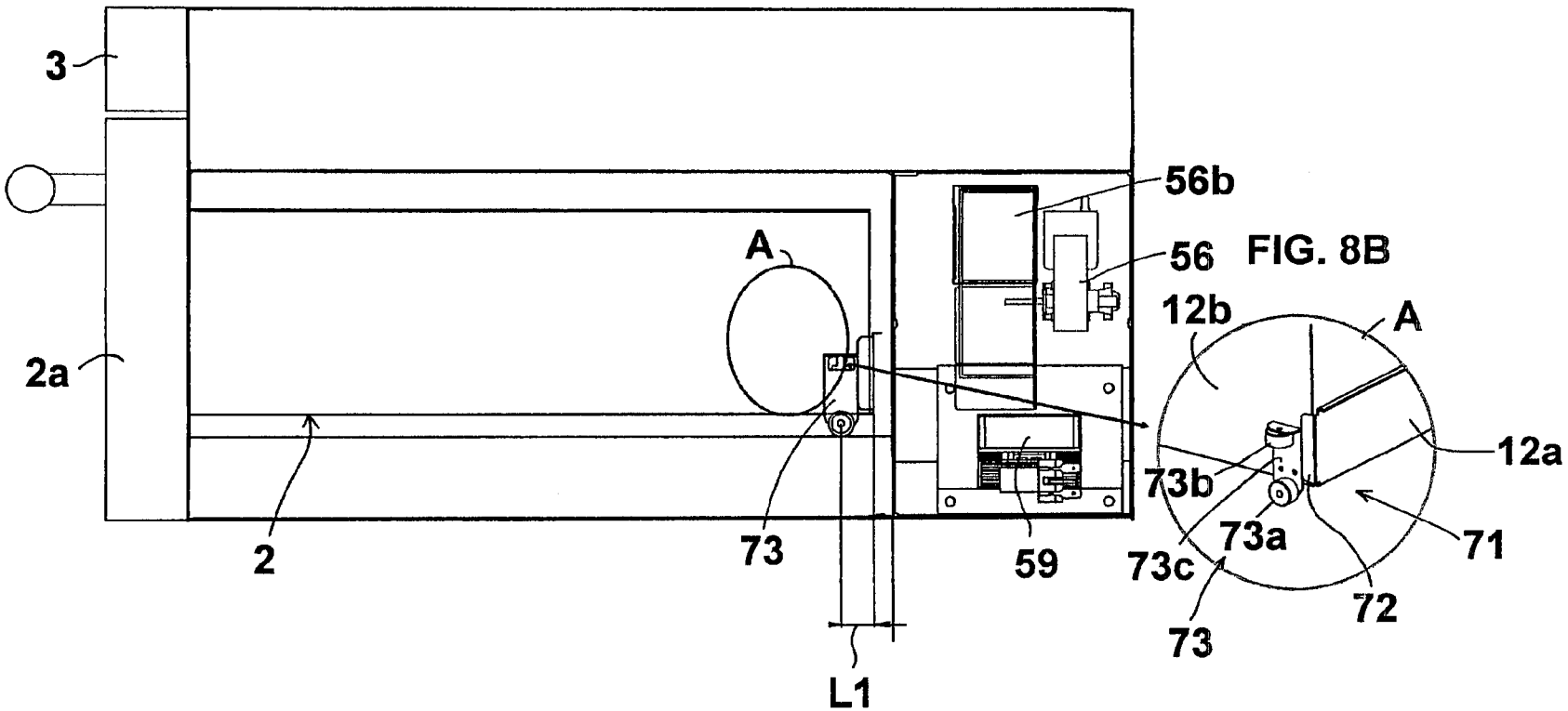
FIG. 8A is a side view showing the rear side chamber of the prior art built-in kitchen equipment.
FIG. 8B is a partially enlarged perspective view of the side view showing the rear side chamber of the prior art built-in kitchen equipment.

Furthermore, since the mounting structure of the support roller of the drawer body 2 is improved, the depth of the heating chamber can be reduced without reducing the size of the opening when the door is drawn out, according to which the set depth dimension can be shortened. That is, as shown in FIGS. 8A and 8B, according to the prior art drawer type cooking device (the overall side view is shown in FIG. 8A) having a box-shaped drawer body 2, a back side panel 12*a* on the rear side is bent over toward a side wall panel 12*b* of the drawer body 2 so as to form a folded portion 72, and the folded portion 72 is welded (preferably via spot welding) to the side wall panel 12*h* of the drawer body 2 so as to form a corner portion 71 (refer to FIG. 8B showing an enlarged perspective view showing the portion A in enlarged view). The support roller unit 73 comprises a bottom wall rolling motion roller 73*a*, a side wall rolling motion roller 73*b*, and a bracket 73*c* for supporting these two rollers 73*a* and 73*b*, wherein the bracket 73*c* is attached adjacent to the corner portion 71 in contact with the folded portion 72. Therefore, the distance from the back wall 12*a* of the drawer body 2 to the rotary shaft core of the two rollers 73*a* and 73*b* will be distance L1 including the folded width of the folded portion 72.

Figure 9:
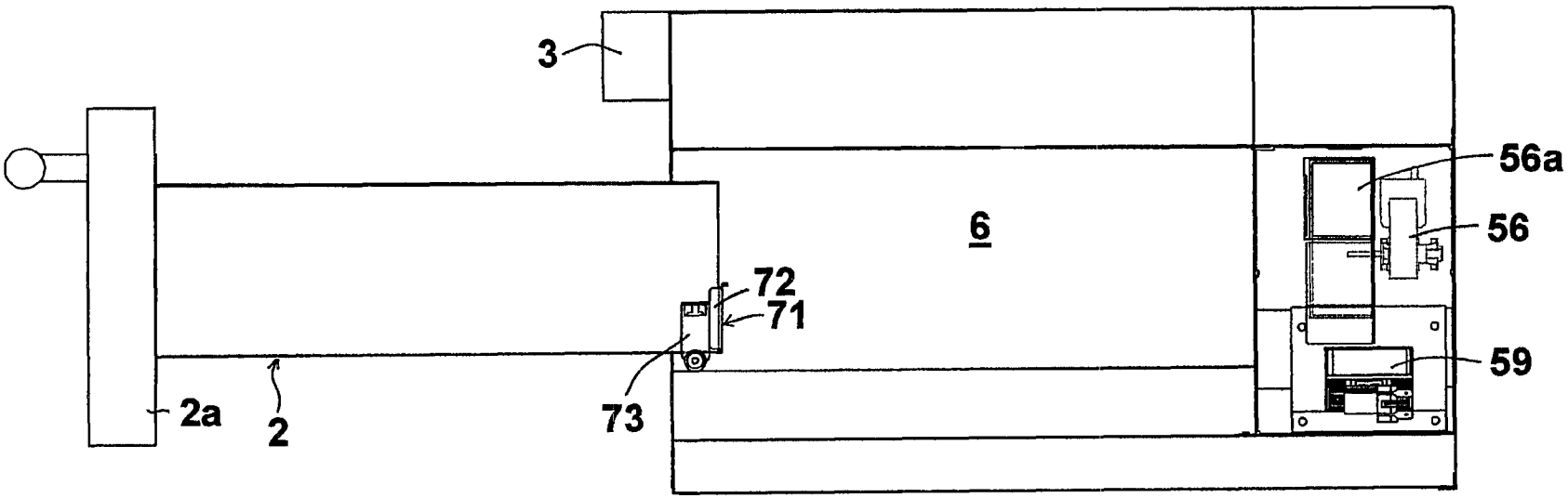
FIG. 9 is a side view showing the built-in kitchen equipment shown in FIGS. 8A and 8B with the drawer body drawn out.

FIG. 9 shows the state where the drawer body 2 is fully drawn out according to the drawer type coking device shown in FIGS. 8A and 8B. Even if the support roller unit 73 is drawn out fully to the forward position, a portion of the drawer body 2 corresponding to the width of the folded portion 72 remains in the heating chamber 6.

The prior art structure of the corner portion 71, that is, the structure in which the back wall panel 12*a* is bent and overlapped to the side wall panel 12*b* and then welded (preferably via spot welding) from the back wall side, was adopted since it was easy to simultaneously perform the folding and spot welding process of the corner portion 71 of the drawer body 2 on the left and right sides. On the other hand, according to the drawer type cooking device of the present invention, the shape and bending direction of the folded portion are changed, so that the side wall panel is bent toward the back wall panel and superposed to the side wall panel, and then spot welded from the direction of the side wall.

Figures 2A, 2B:
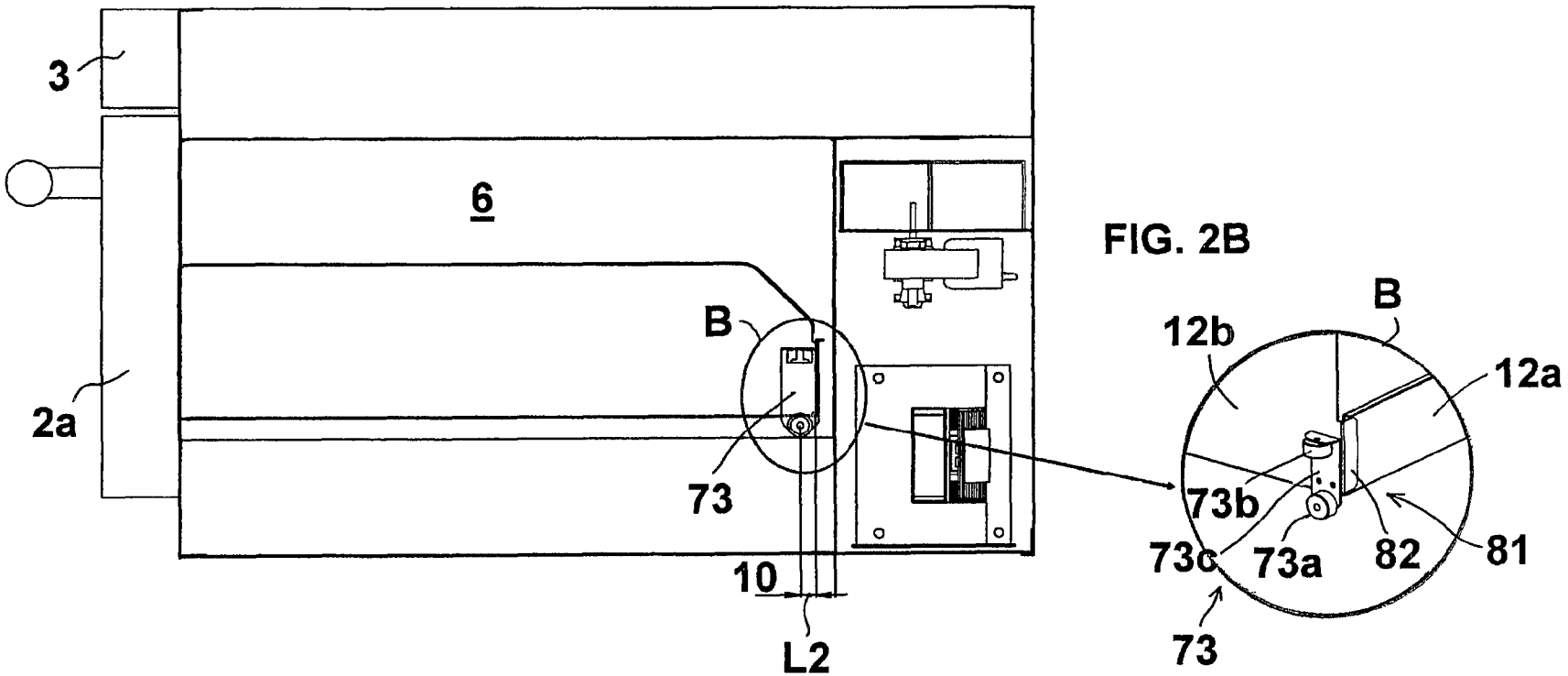
FIG. 2A is a side view of the drawer type cooking device shown in FIGS. 1A and 1B.
FIG. 2B is a partially enlarged perspective view of the drawer type cooking device shown in FIGS. 1A and 1B.

FIGS. 2A and 2B show an embodiment of a drawer type cooking device according to the present invention, wherein FIG. 2A is an overall side view, and FIG. 2B is an enlarged perspective view showing in enlarged view a portion (B) of FIG. 2A. The present embodiment has a varied structure prioritized in attaching the support roller unit 73 adjacent to the corner portion 81. In other words, a folded portion 82 is formed by bending over a rear end portion of the side wall panel 12*b*, and the folded portion 82 is fixed by spot welding to the back wall panel 12*a* of the drawer body 2. The support roller unit 73 is moved rearward to the end of the folded portion 82 of the side panel 12*b*, that is, the position adjacent to the corner portion 81, and attached thereto. Therefore, the distance from the back wall panel 12*a* of the drawer body 2 to the rotary shaft core of rollers 73*a* and 73*b* will be distance L2 not including the folded width of the folded portion 82. Thus, since the position of spot welding of the corner portion 81 of the drawer body 2 is moved toward the back wall panel 12*a*, it becomes possible to attach the support roller unit 73 adjacent to the corner portion 81.

Figure 3:
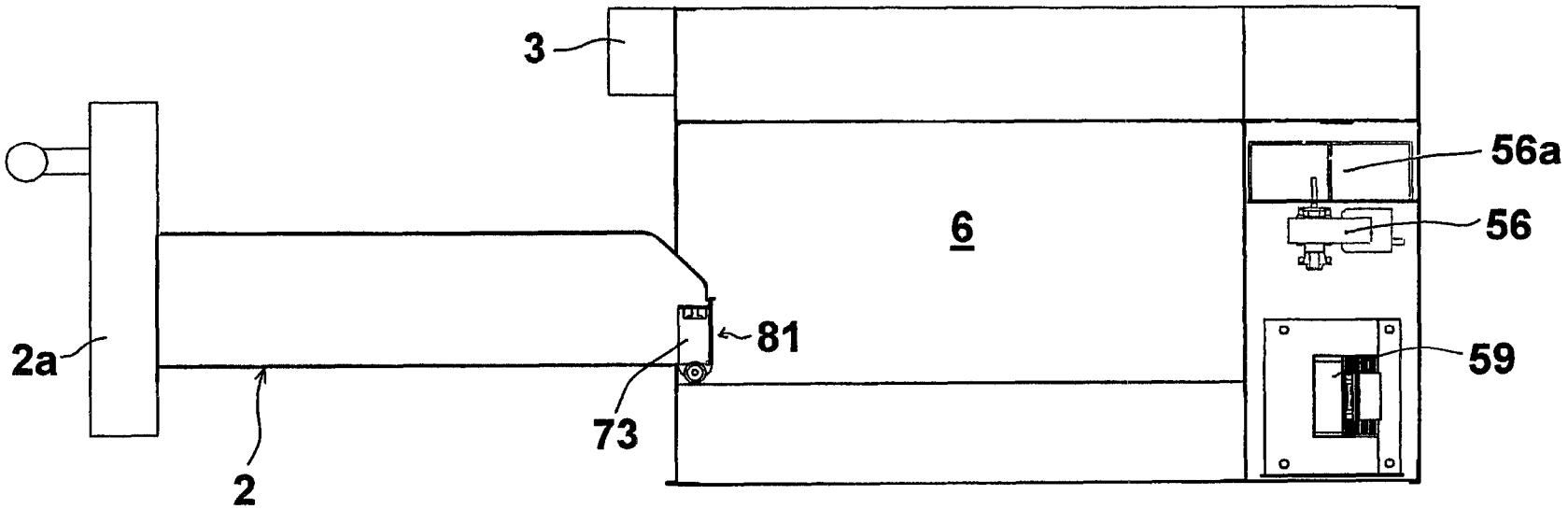
FIG. 3 is a side view showing the drawer type cooking device illustrated in FIGS. 1A and 1B with the drawer body drawn out.
Figure 4:
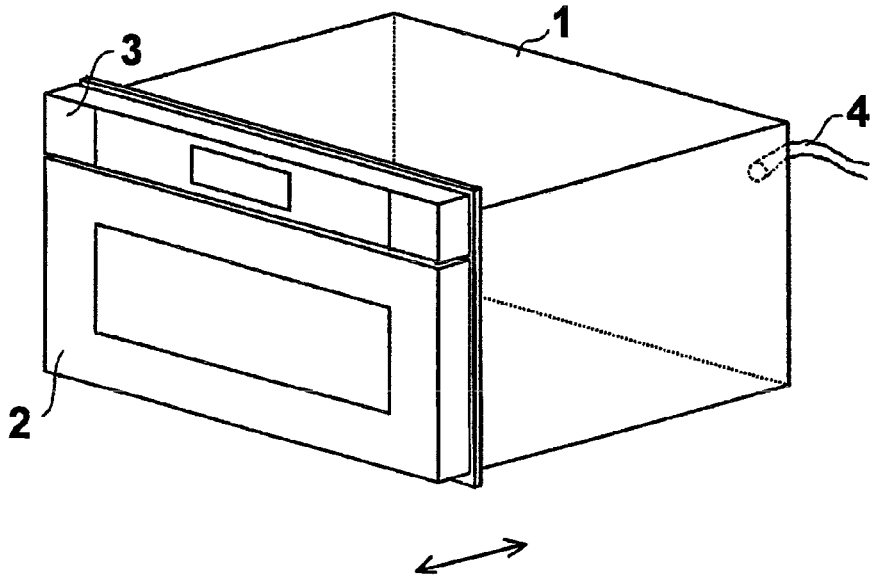
FIG. 4 is a perspective view of one example of a prior art built-in kitchen equipment with the drawer body drawn out.
Figure 5:
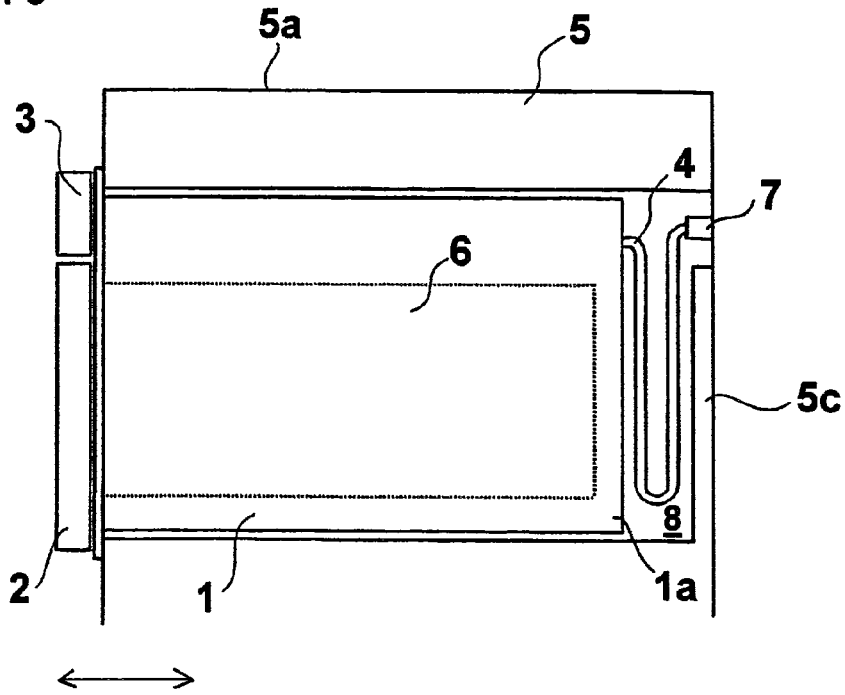
FIG. 5 is a cross-sectional side view of the built-in kitchen equipment shown in FIG. 4.
Figure 6:
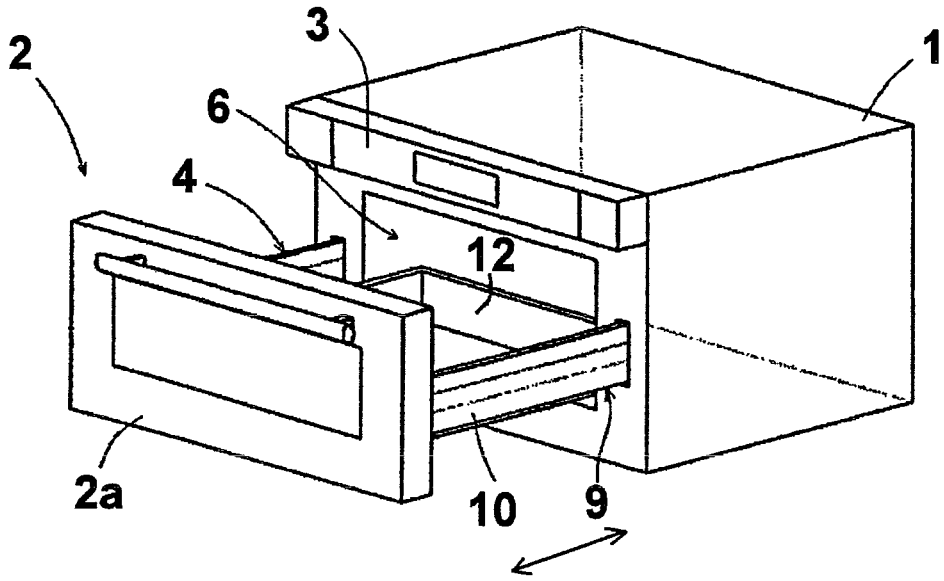
FIG. 6 is a perspective view of the built-in kitchen equipment shown in FIG. 4 with the drawer body drawn out.
Figure 7B:
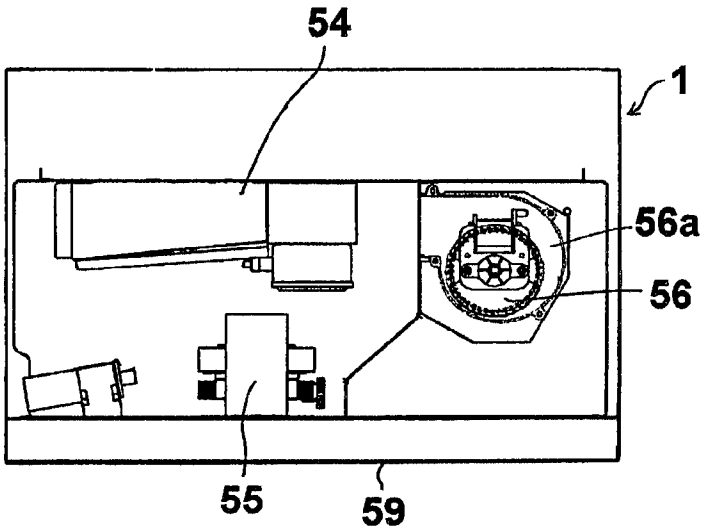
FIG. 7B is a rear side view showing the rear side chamber of the prior art built-in kitchen equipment.
Figure 7A:
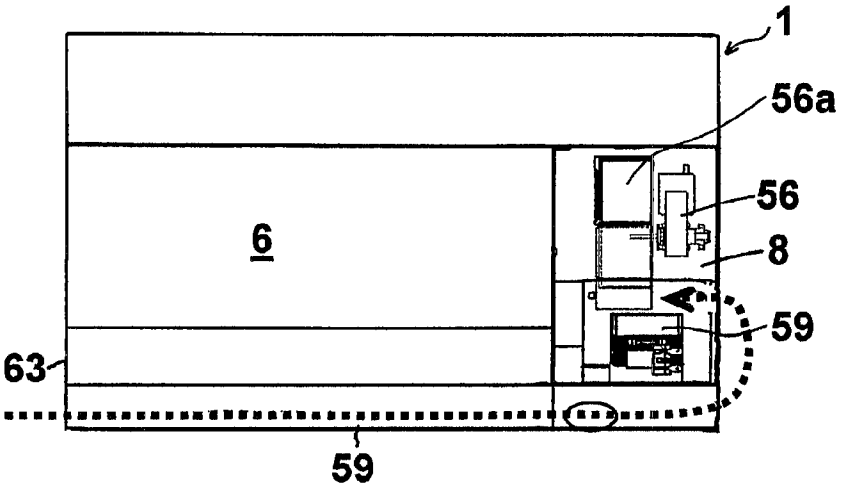
FIG. 7A is a right view showing the rear side chamber of the prior art built-in kitchen equipment.

FIG. 3 shows the state in which the drawer body 2 is fully drawn out according to the drawer type cooking device shown in FIGS. 2A and 2B. As shown in FIG. 3, when the support roller unit 73 is completely drawn out to the frontward direction, the drawer body 2 can be drawn out farther to the frontward direction corresponding to the width of the folded portion 72 than the position shown in FIG. 9.

In designing the structure of the farthest portion of the drawer body 2, the support roller is set as the reference position, so that the shortened distance between the support roller and the corner portion 81 contributes directly to the reduction of depth size of the drawer body 2. Further, by reducing the depth size of the drawer body 2, the depth size of the heating chamber 6 can also be reduced. Thereby, the depth of the drawer body 2 and the depth of the heating chamber 6 can be reduced without reducing the opening size of the drawer body 2 being drawn out, and as a result, the depth size of the body of the cooking device can be reduced.

As described, since the support roller unit 73 is attached adjacent to the corner portion 81, the support roller unit 73 will be in internal contact with the area having high rigidity near the corner between the side wall panel and the back wall panel of the heating chamber when the drawer body 2 is stored at the deepest position, so that even when the user attempts to pull out the drawer body 2 in an oblique direction and a turning moment in the horizontal direction is applied on the drawer body 2, the door resists against the turning moment and will not be turned since it is supported by the rigidity of the heating chamber, and therefore, it becomes possible to prevent a clearance to be formed between only one side of the door 2*a* and the front side panel of the heating chamber. If the drawer body is turned and only one side of the door 2*a* is opened to form a clearance between the front side panel of the heating chamber when an object is being cooked using microwave, the activation of the latch as safety device for detecting the opening of the door and stopping the generation of microwave may be delayed, but the present structure having the support roller unit 73 attached adjacent to the corner portion 81 enable to prevent the delay of activation of the safety device and to improve the reliability of the device, so that it is preferable.

As described in the preferred embodiments, the present invention has improved the structures of the respective portions of the drawer type cooking device based on accumulated trial productions and studies so as to overcome the drawbacks for realizing such device while realizing reduced depth size of the rear portion of the cooking device body, ensuring the heating space on the drawer body 2 and ensuring the volume of the heating chamber 6, to thereby realize a superior interior design in which the front side of the kitchen cabinet can be simplified since the front side of the door 2*a* of the built-in drawer type cooking device is designed to be flush with the front side of the cabinet.

Thus, the drawer type cooking device can have a design unified with the flat-surface design of the kitchen interior having no projections, so that the drawer type cooking device can be part of a superior interior design that was impossible according to the prior art device, and that the drawer type cooking device can answer to the expectations of the majority of users putting weight on interior design. Furthermore, since the drawer type cooking device can synchronize with the latest trend of interior design, the chances of the cooking device being introduced in magazines and other media are increased, and that the evaluation of design property of the drawer type cooking device can be enhanced.

Furthermore, since it is no longer necessary to provide a storage space for the power supply cable 4 on the ceiling surface, the casing structure of the cooking device body 1 can be simplified. Since it becomes possible to omit the forming of the storage portion and the adding of a component for maintaining the rigidity of the casing, the material costs and processing costs can be reduced, and the weight of the cooking device can be cut down.

Moreover, the power supply cable 4 being suspended by the course of the installation construction can be stored in that state, so that the workability is improved and the construction costs are cut down.

The above-described improvement of arrangement and structure is a design improvement that responds to new challenges raised by users at a low cost while satisfying all of the following conditions: the strict safety standards set for microwave ovens performing high frequency cooking operation, limitations regarding the inlet air and outlet air of a built-in structure, and limitations of structure of a drawer type cooking device performing automatic door opening and closing operation. The disclosed invention is realized by a high technical level that can only be achieved by a designer and manufacturer actually performing mass production and sales of such drawer type coking devices, which is far superior to the technical level readily achievable by those in the field of art engaged in the designing and manufacturing of prior art cooking devices.

The present invention can be applied to devices belonging to built-in kitchen equipment such as a microwave oven, an electric oven or a dishwasher, that can be assembled to furniture and cabinets as independent equipment or as components included in composite cooking devices.

What is claimed is:

1. A drawer type cooking device comprising:

a cooking device body having a single heating chamber;

a drawer body disposed movably within the cooking device body via a movement mechanism so as to be drawn out from within the heating chamber;

electric components working to heat an object to be cooked within the heating chamber and a cooling fan disposed on a farthest portion from the front of the cooking device body;

wherein a back panel of the heating chamber is extended in four directions so as to constitute a partition wall with respect to the farthest portion;

the drawer body comprises a door capable of closing a front side opening of the heating chamber when the drawer body is stored in the heating chamber;

the electric components include a high pressure transformer, a high pressure capacitor and a high frequency generation device; and a set depth size of the farthest portion is reduced by combining the arrangements, positions and orientations of the high pressure transformer and the cooling fan.

2. The drawer type cooking device according to claim 1, wherein the cooling fan is positioned laterally and comprising a casing having an air inlet disposed vertically and an air outlet disposed horizontally, the cooking device further comprising a high frequency generation device having a fin-like heat radiation portion disposed close to the air outlet, and a duct-like air flow path for allowing an air flow sent out via the cooling fan through the air outlet to cool the heat radiation portion of the high frequency generation device and to flow through an opening formed on the wall surface of the heating chamber into the heating chamber;

an air flow generated by the cooling fan flows from a lower portion of the front side of the cooking device into the cooking device, passes through multiple openings formed on the back panel to be separated into multiple air flows flowing into the farthest portion and cooling the electric components; and the multiple air flows are sucked into the casing and converged, and a large portion of the air flow flowing through the air outlet of the casing flows into the duct-like air flow path.

3. The drawer type cooking device according to claim 2, wherein the air flow flowing through the openings into the heating chamber flows out through an air outlet opening formed on a ceiling panel of the heating chamber as outlet air, is introduced to the lower portion of the cooking device via an air outlet duct disposed mainly in a perpendicular direction extending from the air outlet opening to a bottom portion of the heating chamber, and discharged to an exterior of the cooking device from the lower portion of the front side of the cooking device.

4. The drawer type cooking device according to claim 3, wherein the drawer body comprises on an end of the farthest portion thereof a support roller that rolls on a side wall surface of the heating chamber to generate a pressure with respect to the side wall surface to support the drawer body until the drawer body reaches a position completely drawn out from the heating chamber;

the drawer body has a box-like shape in which stretched portions of metal panels formed by stretching the side wall panels are bent and superposed with the back wall panel, and the side wall panels and the back wall panel are spot-welded at the superposed portions;

support roller mounting portions are spot-welded and fixed to areas of the side wall panels adjacent to left and right corners at the lower back end portion of the side wall panels; and the depth sizes of the drawer body and the heating chamber are reduced by reducing the portion of the drawer body protruded toward the back side of the drawer body from the support roller mounting portions.

5. The drawer type cooking device according to claim 3, wherein the drawer type cooking device is built into a kitchen cabinet.

6. The drawer type cooking device according to claim 2, wherein the drawer body comprises on an end of the farthest portion thereof a support roller that rolls on a side wall surface of the heating chamber to generate a pressure with respect to the side wall surface to support the drawer body until the drawer body reaches a position completely drawn out from the heating chamber;

the drawer body has a box-like shape in which stretched portions of metal panels formed by stretching the side wall panels are bent and superposed with the back wall panel, and the side wall panels and the back wall panel are spot-welded at the superposed portions;

support roller mounting portions are spot-welded and fixed to areas of the side wall panels adjacent to left and right corners at the lower back end portion of the side wall panels; and the depth sizes of the drawer body and the heating chamber are reduced by reducing the portion of the drawer body protruded toward the back side of the drawer body from the support roller mounting portions.

7. The drawer type cooking device according to claim 2, wherein the drawer type cooking device is built into a kitchen cabinet.

8. The drawer type cooking device according to claim 1, wherein the drawer body comprises on an end of the farthest portion thereof a support roller that rolls on a side wall surface of the heating chamber to generate a pressure with respect to the side wall surface to support the drawer body until the drawer body reaches a position completely drawn out from the heating chamber;

the drawer body has a box-like shape in which stretched portions of metal panels formed by stretching the side wall panels are bent and superposed with the back wall panel, and the side wall panels and the back wall panel are spot-welded at the superposed portions;

support roller mounting portions are spot-welded and fixed to areas of the side wall panels adjacent to left and right corners at the lower back end portion of the side wall panels; and the depth sizes of the drawer body and the heating chamber are reduced by reducing the portion of the drawer body protruded toward the back side of the drawer body from the support roller mounting portions.

9. The drawer type cooking device according to claim 1, wherein the drawer type cooking device is built into a kitchen cabinet.

10. The drawer type cooking device according to claim 9, wherein a front surface of the kitchen cabinet and a front surface of the door are disposed flush with each other.

11. A drawer type cooking device comprising:

a cooking device body having a single heating chamber;

a drawer body disposed movably within the cooking device body via a movement mechanism so as to be drawn out from within the heating chamber;

electric components working to heat an object to be cooked within the heating chamber and a cooling fan disposed on a farthest portion from the front of the cooking device body;

wherein a back panel of the heating chamber is extended in four directions so as to constitute a partition wall with respect to the farthest portion;

the drawer body comprises a door capable of closing a front side opening of the heating chamber when the drawer body is stored in the heating chamber;

the electric components include a high pressure transformer, a high pressure capacitor and a high frequency generation device; and a set depth size of the farthest portion is reduced by combining the arrangements, positions and orientations of the high pressure transformer and the cooling fan, wherein the cooling fan is positioned laterally and comprising a casing having an air inlet and an air outlet, the cooking device further comprising a high frequency generation device having a heat radiation portion disposed close to the air outlet, and an air flow path for allowing an air flow sent out via the cooling fan through the air outlet to cool the heat radiation portion of the high frequency generation device and to flow through an opening formed on the wall surface of the heating chamber into the heating chamber;

an air flow generated by the cooling fan flows from a portion of the front side of the cooking device into the cooking device, passes through at least one opening formed on the back panel to define a further air flow flowing into the farthest portion and cooling the electric components; and the further air flow is sucked into the casing and converged, and a large portion of the air flow flowing through the air outlet of the casing flows into the air flow path.

12. The drawer type cooking device according to claim 11, wherein the air flow generated by the cooling fan flows from a lower portion of the front side, the air inlet is disposed vertically and the air outlet disposed horizontally, the heat radiation portion as finlike characteristics, and the air flow path is duct-like.

* * * * *